US006497336B2

(12) United States Patent
Grayer

(10) Patent No.: US 6,497,336 B2
(45) Date of Patent: Dec. 24, 2002

(54) COVER FOR A CONTAINER OPENABLE BY PEELING, COMPRISING A GRIPPING TAB DELIMITED

(75) Inventor: Alain J. Grayer, Witternheim (FR)

(73) Assignee: Societe Alsacienne D'Aluminium (FR)

( * ) Notice: Subject to any disclaimer, the term of this patent is extended or adjusted under 35 U.S.C. 154(b) by 0 days.

(21) Appl. No.: 09/828,388

(22) Filed: Apr. 6, 2001

(65) Prior Publication Data

US 2002/0003143 A1 Jan. 10, 2002

(30) Foreign Application Priority Data

Apr. 7, 2000 (FR) ..... 00 04454

(51) Int. Cl.[7] ..... B65D 39/02
(52) U.S. Cl. ..... 220/359.2; 220/359.3
(58) Field of Search ..... 220/359.2, 359.3, 220/258.2, 270; 215/232, 254

(56) References Cited

U.S. PATENT DOCUMENTS 3,317,068 A * 5/1967 Betner ..... 215/233
4,020,969 A * 5/1977 Ando ..... 220/359.2
4,087,018 A * 5/1978 Tebbutt ..... 220/359.2
4,625,875 A * 12/1986 Carr et al. ..... 215/232
4,773,557 A * 9/1988 Ohta ..... 220/258.2
4,960,216 A * 10/1990 Giles ..... 215/232
5,514,442 A * 5/1996 Galda et al. ..... 215/232

FOREIGN PATENT DOCUMENTS

FR 2127891 * 10/1972
JP 5-4642 * 1/1993

* cited by examiner

*Primary Examiner*—Nathan J. Newhouse
(74) *Attorney, Agent, or Firm*—Gerald E. Hespos; Anthony J. Casella

(57) ABSTRACT

A lid for a container is openable by peeling. The lid includes a first layer adhered to a second layer (5) having, on its outer face, a sealing agent (6) enabling it to adhere to the container (1, 2). The first layer (3) has a cut-out portion (7) delimiting a gripping tab (8). In addition, the force of adherence between the first and second layers (3, 5) is greater than the force of adherence between the second layer (5) and the container (1, 2). Alternatively, the lid includes a third layer (13) adhered to the first layer (3) and having a hole (15) permitting access to the tab (8).

6 Claims, 1 Drawing Sheet

FIG.1
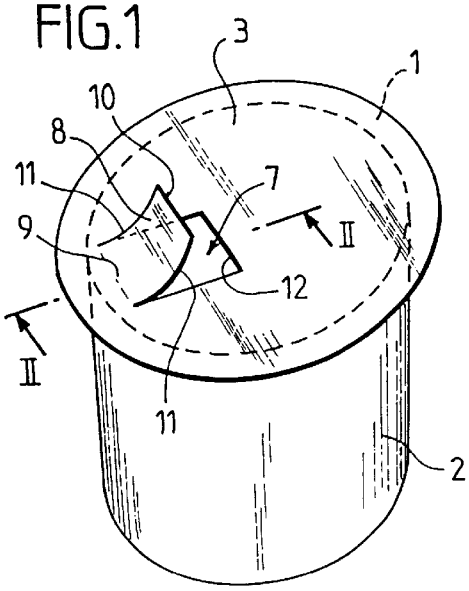
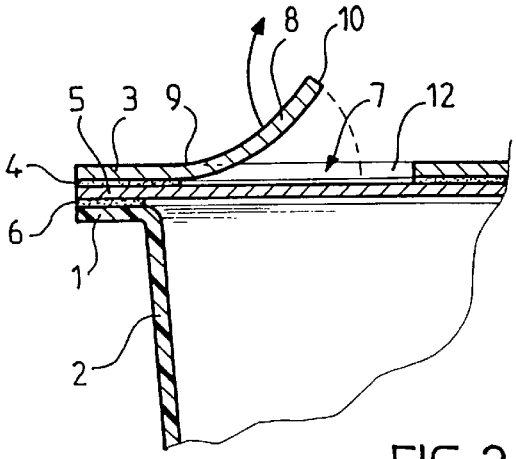
FIG.2
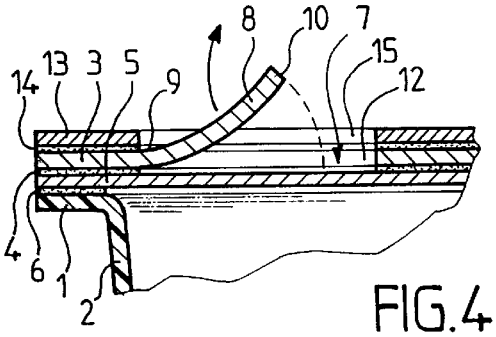
FIG.4
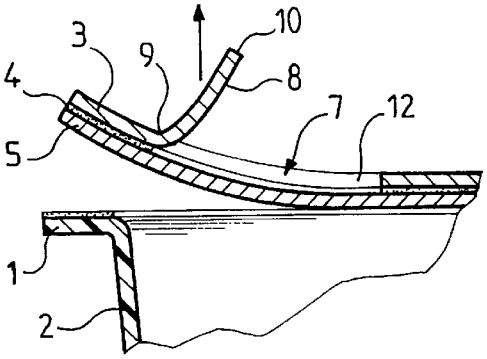
FIG.3
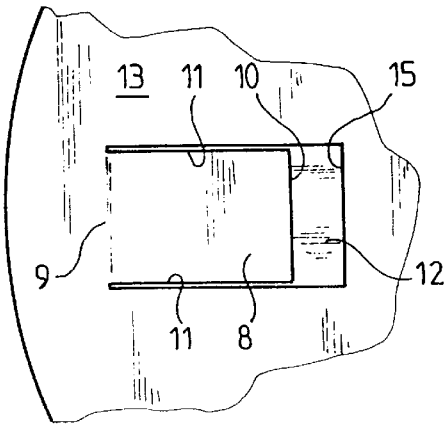
FIG.5
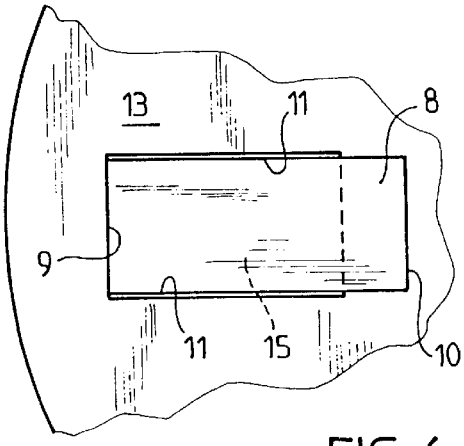
FIG.6

COVER FOR A CONTAINER OPENABLE BY PEELING, COMPRISING A GRIPPING TAB DELIMITED

The present invention relates to a lid for a container openable by peeling, including a first layer adhered to a second layer comprising a sealing agent on its outer face, this agent being designed to enable the lid to adhere to the recipient by sealing.

Lids designed to be fixed by sealing to containers that are openable by peeling are generally provided with a gripping tab forming a lateral protuberance.

Now, when the lids are fixed by heat sealing, part of the heat supplied is locally absorbed by the tab, so that the seal at the base of the latter is often of poorer quality and less strong than elsewhere.

The present invention proposes, in particular, to remedy this drawback and, to do so, it provides a lid having the structure mentioned above, this lid being characterised in that the first layer comprises an internal cut-out portion delimiting a gripping tab, and in that the force of adherence between the first and second layers is greater than the force of adherence between the second layer and the recipient.

The gripping tab of this lid does not constitute a lateral protuberance as it is located in the area of a cut-out portion provided inside the first layer.

The heat supplied to perform sealing thus remains uniformly distributed along the line along which the lid adheres to the container, which prevents the occurrence on this line of zones of adherence of variable quality and strength.

It will further be noted that the forces of adherence, which are different between the layers constituting the lid, on one hand, and between the lid and the recipient, on the other hand, guarantee correct opening without the layers parting from one another.

Preferably, the tab comprises a root portion connecting it to the first layer, a free end opposite from the root portion, and two sides connecting the root portion to the free end, a hole being provided in the first layer so as to be delimited at least partially by the free end of the tab.

Thanks to this hole, the tab can be more easily taken hold of with a view to opening the container.

According to one particular form of embodiment, the lid according to the invention includes a third layer, adhered to the first layer and comprising a hole permitting access to the tab.

The third layer enhances the strength of the lid and prevents the tab from becoming accidentally separated from the first layer when it is pulled on with a view to opening the container.

To make it easier to grip the tab, the hole in the third layer is, preferably, at least as large as the tab.

According to a first variant, the hole in the third layer is delimited, at least partially, by the free end of the tab and/or by at least one of the sides of the latter.

According to a second variant, the hole in the third layer is defined by a special cut-out portion delimiting an additional tab covering, at least partially, the tab of the first layer, the additional tab being integral with the first one.

According to a third variant, the tab of the first layer extends, at least partially, over the third layer so as to be easier to grip with the hand.

Finally, it should be specified that each of the first, second and third layers is made of paper or of aluminium, or is constituted by a film of plastic material.

Several forms of embodiment of the present invention will be described below by way of by no means limitative examples, with reference to the annexed drawings, in which:

FIG. 1 is a perspective view showing a container closed by a two-layer lid according to the invention, with the tab of the lid raised;

FIG. 2 is a view in partial cross-section, and on a larger scale, along line 11—11 of FIG. 1;

FIG. 3 is a view analogous to that of FIG. 2, but showing the container in the process of being opened;

FIG. 4 is a view in partial cross-section, and on a larger scale, analogous to that of FIG. 2, but showing a three-layer lid;

FIG. 5 is a schematic, partial top view of the lid shown in FIG. 4; and

FIG. 6 is a top view analogous to that of FIG. 5, but showing an alternative embodiment of the three-layer lid.

FIGS. 1 and 2 show a lid sealed to the rim 1 delimiting the entry to a container 2 made, preferably, of plastic material.

This lid includes a first layer 3, fixed by means of an adhesive agent 4 to a second layer 5, itself fixed to the rim 1 of the container by means of a sealing agent 6.

The sealing agent 6 used is of a composition that is suitable to enable the lid to be cold or hot-fixed to rim I of the container and to be peeled off, whatever the method used to seal the lid.

First layer 3 comprises a cut-out portion 7 delimiting a gripping tab 8 and adheres to second layer 5 with a force that is greater than that which fixes the lid to rim 1 of the container.

Thus, when traction is applied to tab 8 in order to open container 2, there is no risk of layers 3 and 5 coming apart.

Tab 8 comprises a root portion 9 by which it is connected to the first layer, a free end 10, opposite from its root portion, and two longitudinal sides 11 interconnecting its free end and its root portion.

In the example shown in FIGS. 1 and 2, cut-out portion 7 is designed in such a way that a hole 12 extends ahead of free end 10 of tab 8 and enables the latter to be gripped more easily.

It will be noted here that it is desirable that there should be no adhesive agent 4 between layers 3 and 5 directly below the tab, to ensure that the latter can easily be separated from layer 5 as result of traction applied upwards from its free end 10.

It will also be noted that hole 12 could, if necessary, extend ahead of one, at least, of the two longitudinal sides 11 of the tab.

FIG. 3 shows that it suffices to seize tab 8 and to apply upward traction thereto in order to open container 2.

FIGS. 4 and 5 show another lid according to the invention. This other lid is distinguished, in fact, from the one that has just been described in that it includes a third layer 13 fixed to first layer 3 by means of an adhesive 14 and comprising a hole 15 permitting easy access to tab 8.

In the example shown in FIGS. 4 and 5, hole 15 has the same dimensions as cut-out portion 7 provided in first layer 3, but there is no reason why it should not be larger. It could, indeed, for example, allow the first layer to appear over a predetermined width along one, at least, of the two sides of tab 8.

As clearly shown by FIG. 4, hole 15 in the third layer comprises a side located just above root portion 9 of the tab.

Any risk of the tab becoming accidentally separated from first layer 3 when traction is applied thereto is thus completely obviated.

In FIGS. 4 and 5, hole 15 provided in third layer 13 reveals tab 8. It could, however, be defined by a cut-out portion delimiting an additional tab partially, or totally, covering tab 8. In this form of embodiment, the additional tab would be integral with the latter, which would thus be reinforced.

FIG. 6 shows an alternative embodiment of the lid shown in FIGS. 4 and 5.

According to this variant, tab 8 extends partially above third layer 13, which makes it yet easier to grip.

In this particular embodiment, third layer 13 covers an empty space corresponding to the extension thereover of tab 8 as well as to hole 12, discussed in connection with FIGS. 1 to 3.

Finally, it is to be noted that layers 3, 5 and 13 can be made of paper or aluminium, or be constituted by a film of plastic material.

What is claimed is:

1. Lid for a container openable by peeling, including a first layer (3) adhered to a second layer (5) comprising a sealing agent (6) on its outer face, this agent being designed to enable the lid to adhere to the container (1, 2) by sealing, characterised in that the first layer (3) comprises an internal cut-out-portion (7) delimiting a gripping tab (8), and in that the force of adherence between the first and second layers (3, 5) is greater than the force of adherence between the second layer (5) and the container (1, 2), the tab (8) comprising a root portion (9) connecting it to the first layer (3), a free end (10) opposite from the root portion and two sides (11) connecting the root portion to the free end, a hole (12) being provided in the first layer so as to be delimited at least partially by the free end of the tab, a third layer (13) being adhered to the first layer (3) and comprising a hole (15) permitting access to the tab (8).

2. Lid according to claim 1, characterised in that the hole (15) in the third layer (13) is at least as large as the tab (8).

3. Lid according to claim 2, characterised in that the hole (15) in the third layer (13) is delimited, at least partially, by the free end (10) of the tab (8) and/or by one, at least, of the sides (11) of the latter.

4. Lid according to claim 1, characterized in that the hole (15) in the third layer (13) is defined by a special cut-out portion delimiting an additional tab covering, at least partially, the tab (8) of the first layer (3), the additional tab being integral with the tab of the first layer.

5. Lid according to claim 1, characterized in that the tab (8) extends, at least partially, over the third layer (13).

6. Lid according to claim 1, characterized in that each of the first, second and third layers (3, 5, 13) is made of a material selected from the group consisting of paper, aluminum and a film of plastic material.

* * * * *